United States Patent [19]

Martin et al.

[11] Patent Number: 4,948,387

[45] Date of Patent: Aug. 14, 1990

[54] SYNTHESIS GAS BARRIER AND REFRACTORY SUPPORT

[75] Inventors: Michael C. Martin, Houston, Tex.; Erwin A. Reich, Stamford, Conn.

[73] Assignee: Texaco Inc., White Plains, N.Y.

[21] Appl. No.: 440,836

[22] Filed: Nov. 24, 1989

[51] Int. Cl.[5] ..... C10J 3/86

[52] U.S. Cl. ..... 48/62 R; 48/67; 48/69; 48/77; 48/DIG. 2; 122/7 R

[58] Field of Search ..... 48/62 R, 63, 64, 67, 48/69, 76, 77, 87, DIG. 2, 73; 122/6 A, 7 R

[56] References Cited

U.S. PATENT DOCUMENTS

| | | | |
|---|---|---|---|
| 4,071,329 | 1/1978 | Eales | 48/77 |
| 4,309,196 | 1/1982 | Vollhardt | 48/69 |
| 4,377,132 | 3/1983 | Koog et al. | 48/69 |
| 4,437,864 | 3/1984 | Gorris et al. | 48/62 R |
| 4,462,339 | 7/1984 | Jahnke et al. | 122/7 R |
| 4,525,176 | 6/1985 | Koog et al. | 48/DIG. 2 |
| 4,605,423 | 8/1986 | Koog | 48/69 |
| 4,768,470 | 9/1988 | Ziegler | 122/7 R |
| 4,818,253 | 4/1989 | Kohmen | 48/67 |

*Primary Examiner*—Peter Kratz

*Attorney, Agent, or Firm*—Robert A. Kulason; James J. O'Loughlin; Albert Brent

[57] ABSTRACT

This invention relates to a combination comprising two vertical cylindrical shaped high temperature pressure vessels coaxially connected. The upper vessel is a refractory lined free-flow partial oxidation gas generator for the production of gaseous mixtures comprising $H_2+CO$ from liquid hydrocarbonaceous and solid carbonaceous fuels. The lower vessel houses a radiation gas cooler for cooling the raw gas stream which is produced in the upper vessel and which passes down through a coaxial vertical cylindrical annular shaped refractory throat located between said upper and lower vessels. A vertical steel cylindrical gas barrier provided with a flanged bottom surrounds the refractory throat passage so that substantially no gas escapes into a stagnant annular zone outside of said gas barrier. Further the refractory throat is vertically supported by said flanged gas barrier. Supporting elements connected to the upper vessel are provided for supporting the gas barrier so that its lower end is free to move by thermal expansion.

9 Claims, 2 Drawing Sheets

SYNTHESIS GAS BARRIER AND REFRACTORY SUPPORT

FIELD OF THE INVENTION

This invention relates to partial oxidation gas generators and gas coolers in general. More particularly, it relates to a combination gas barrier and support shelf that prevents the escape of hot raw effluent gas stream passing downward through a refractory throat passage that connects the gas generator with the gas cooler.

DESCRIPTION OF THE PRIOR ART

The partial oxidation process is a well known process for converting liquid hydrocarbonaceous fuels, e.g., petroleum and solid carbonaceous fuels, e.g., coal and petroleum coke into gaseous mixtures comprising $H_2+CO$. Depending on the actual composition, the effluent gas stream from the gas generator is called synthesis gas, reducing gas, or fuel gas. For example, see coassigned U.S. Pat. Nos. 3,544,291; 3,607,157; 3,998,609 and 4,289,502, which are incorporated herein by reference.

The partial oxidation reaction takes place in a vertical steel cylindrical free-flow unobstructed refractory lined pressure vessel, such as shown and described in coassigned U.S. Pat. No. 4,525,176, which is incorporated herein by reference. The hot raw effluent gas stream leaving the gas generator may be cooled in water contained in a quench tank, such as shown and described in coassigned U.S. Pat. No. 4,605,423. Alternatively, the hot raw process gas stream is cooled by indirect heat exchange with boiler feel water in a radiant or convection cooler, such as shown and described in U.S. Pat. Nos. 4,377,132 and 4,462,339, which are incorporated herein by reference. Thus, it is an object of this invention to provide in combination with a synthesis gas generator and a synthesis gas cooler, a combination gas barrier and refractory shelf support which prevents the escape of the hot raw effluent gas stream passing through the refractory throat passage located between the gas generator and the gas cooler.

BRIEF SUMMARY OF THE INVENTION

Briefly, the invention is in combination with a high temperature gas generator comprising a refractory lined vertical cylindrical shaped pressure vessel for the partial oxidation of a liquid hydrocarbonaceous or solid carbonaceous fuel to produce gaseous mixtures comprising of $H_2+CO$; and a coaxially aligned vertical cylindrical shaped steel pressure vessel connected below said gas generator. The lower pressure vessel houses a gas cooler and waste heat boiler which cools the hot raw effluent gas stream from said gas generator by indirect heat exchange with boiler feed water. Also included are connecting means for joining the two vessels together, a vertical cylindrical annular shaped elongated refractory throat coaxial with the first and second vessels and extending therebetween, and a concentric coaxial vertical steel cylindrical gas barrier that surrounds said refractory throat. The gas barrier includes on the downstream end a concentric coaxial annular shaped flange with a portion extending inwardly for supporting the bottom of said refractory throat. Means for connecting said cylindrical gas barrier to said first vessel and sealing means to provide a stagnant annular zone radially disposed outwardly from said cylindrical gas barrier to the inside walls of said vessels are also provided. By the subject invention, differential axial and/or radial growth of the cylindrical gas barrier is allowed. However, substantially no raw effluent gas stream passing through said refractory throat escapes into said stagnant annular zone.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENT

Figure 1:
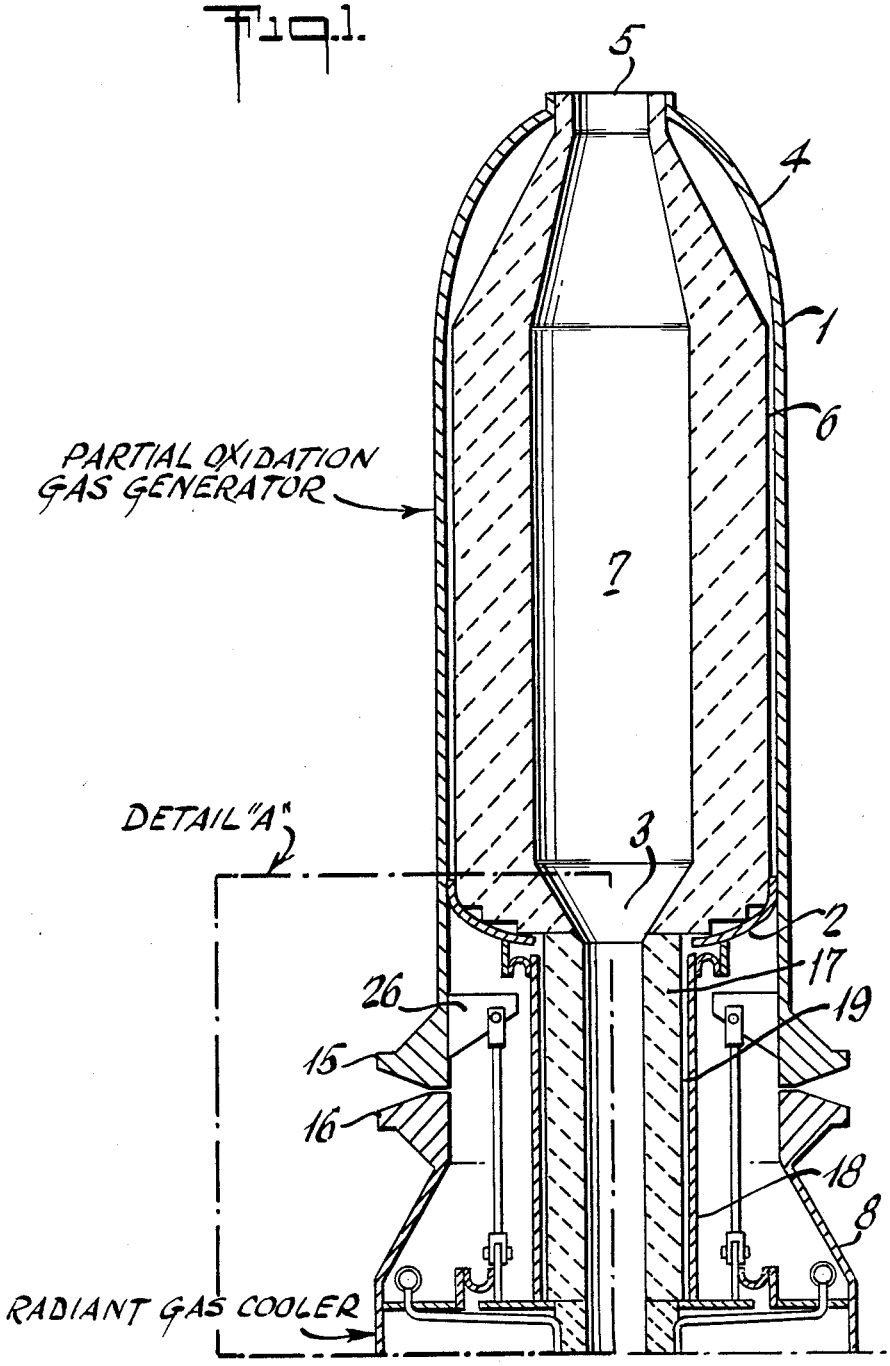
FIG. 1 is a schematic cross sectional view showing the gas generator in coaxial alignment with the gas cooler, including the structure for the connecting throat and the gas barrier and support for the refractory throat passage according to the subject invention.

FIG. 1 illustrates in a schematic manner, a first vertical cylindrical shaped elongated high temperature steel pressure vessel 1 provided with a retracted internal lower head 2 containing bottom exit passage 3 along the central longitudinal axis of said vessel and an upper head 4 containing a coaxial inlet passage 5 for the insertion of a conventional downwardly discharging gasification burner (not shown). Vessel is the exterior shell of a thermal refractory 6 lined reaction zone 7 of a partial oxidation gas generator which is used for the production of synthesis gas, reducing gas, or fuel gas. The flanged bottom end 15 of vessel 1 is connected to the flanged upper end 16 of a second vertical cylindrical shaped elongated high temperature steel pressure vessel 8. Vessel 8 is the exterior shell of a gas cooler and waste heat boiler. Connecting means (not shown), such as conventional bolts and/or clamps, are used to join the lower flanged end 15 of said first vessel to upper flanged end 16 of said second vessel to provide coaxial alignment along the central longitudinal axis of each vessel. A vertical cylindrical annular shaped elongated thermal refractory throat of throat brick 17 is coaxial with said first and second vessels and extends therebetween for the free passage of the hot raw effluent gas stream flowing downwardly from said reaction zone 7 to said radiant gas cooler in vessel 8. A concentric coaxial vertical steel cylindrical gas barrier 18 surrounds the outside diameter 19 of said refractory throat 17 and is more clearly shown in Detail "A".

Figure 2:
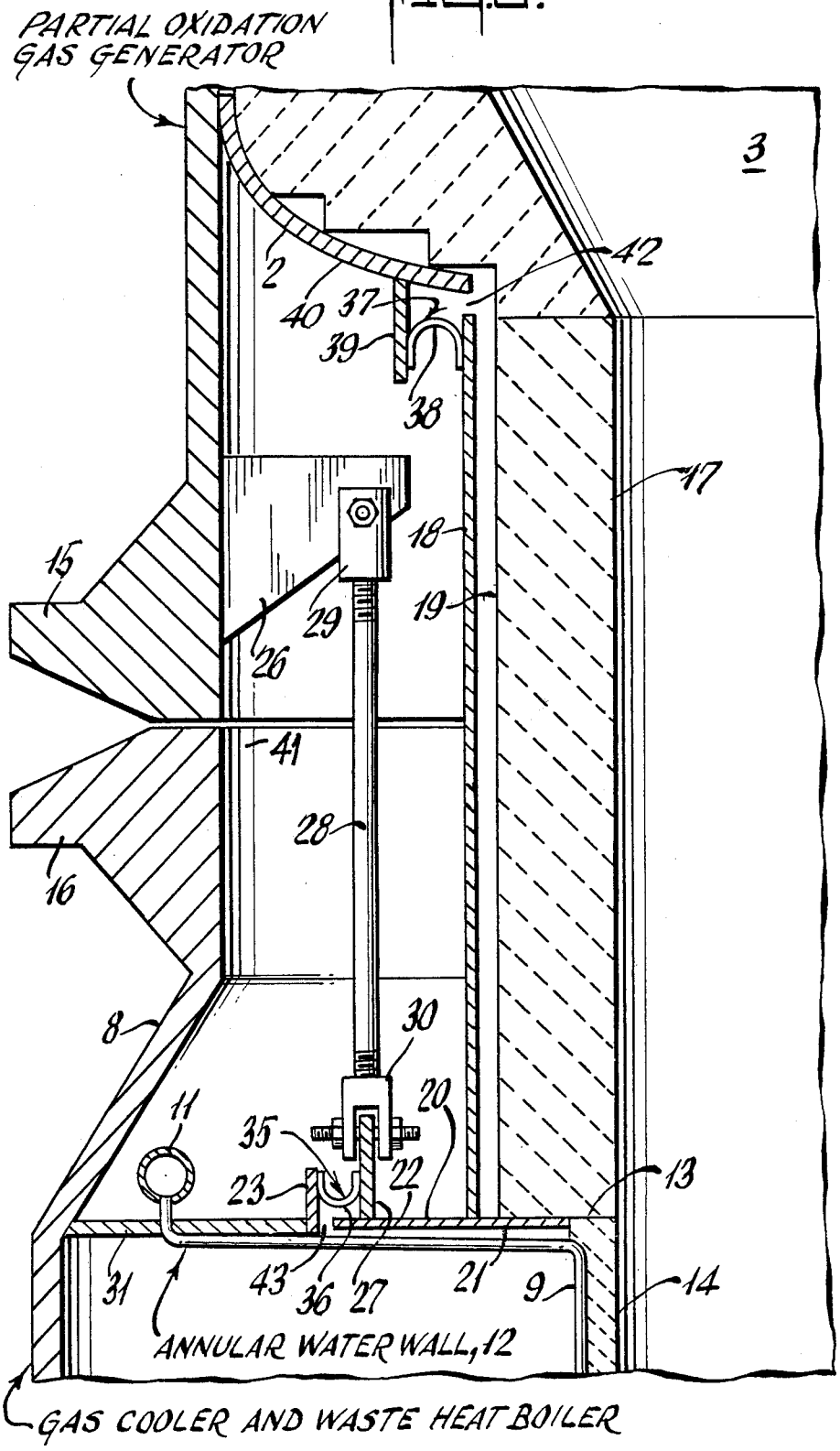
FIG. 2 is an enlarged cross sectional view showing Detail "A" of the throat structure and the gas barrier and support for the refractory throat passage according to this invention and as taken from FIG. 1.

FIG. 2 illustrates in a schematic manner enlarged Detail "A" of FIG. 1. Vertical cylindrical pressure vessel 1 containing central bottom exit passage 3 of the partial oxidation reaction zone is joined to vertical cylindrical shell 8 of gas cooler and waste heat boiler 9 by clamping together flanges 15 and 16. Gas cooler and waste heat boiler 9 is of the conventional type, such as that shown in coassigned U.S. Pat. No. 4,377,132, which is incorporated herein by reference. Included in gas cooler 9 is coaxial refractory inlet passage 14, and steam drum 11, which is connected to annular water wall 12 and other gas cooling tubes. Boiler feed water is introduced into the water wall tubes of the radiation boiler. Steam is generated inside the water wall tubes by vaporization of the water and heat is thereby removed from the hot synthesis gas flowing down the gas cooler. Solidified slag entrained in the gas stream may be removed at the bottom of the radiation boiler. The water wall is constructed with parallel water tubes having fins or otherwise joined together to form vertical cylindrical (see reference numbers 15 and 23 in the drawing for coassigned U.S. Pat. No. 4,377,132), and (2) flat annular surface 12. Coaxial vertical refractory throat 17 extends downward from the bottom of refractory lined bottom exit passage 3 to the top 13 of refractory throat 14 at the entrance to radiant cooler 9.

Metal gas barrier 18 includes at it downstream end a horizontal concentric coaxial annular flange 20 comprising inwardly 21 and outwardly 22 radially extending portions. The inwardly extending portion 21 of said flange supports said vertically shaped refractory throat column 17 at the bottom.

Metal gas barrier 18 is vertically supported by a support means. The upper end of the support means is fastened to vessel 1 while the lower end is free to move by thermal expansion. In a preferred embodiment of the support means, vertical leg of triangular shaped gusset plate 26 is welded to the inside surface of vessel 1 so that the other leg projects radially and horizontally. There may be, for example, four gusset plates 26 spaced 90° apart. A vertically extending concentric coaxial ring 27 is positioned vertically below plate 26 and is attached to outwardly extending portion 22 of annular flange 20. Vertical hanger rod 28 (4 of) with end fittings 29 and 30 are removably connected between gusset plate 26 and ring 27. Coaxial vertically extending ring 23 is radially disposed a little beyond ring 27 and fixed in position by suitable means, for example, by welding to annular water wall 12. Alternatively, ring 23 may be held in position by being secured to annular ring 31. Annular ring 31 extends horizontally and radially and is secured by welding the outside diameter to the inside wall of vessel 8.

Lower flexible joint gas sealing means 35 is made by attaching opposite edges of flexible u-shaped concentric coaxial annular sheet metal ring 36 to the inside surface of upwardly extending concentric coaxial ring 27 and to the inside surface of upwardly extending concentric coaxial ring 23. Upper flexible joint gas sealing means 37 is made by attaching opposite edges of flexible u-shaped coaxial annular sheet metal ring 38 to the outside surface of cylindrical gas barrier 18 near its upper end, and to the inside surface of vertically depending concentric coaxial ring 39. Ring 39 is radially disposed a little beyond upwardly extending vertical cylindrical gas barrier 18 and is welded to the outside bottom surface of retracted bottom head 40 of gas generator 1. Substantially no raw effluent gas stream passing through refractory throat 17 passes through lower flexible joint 35 and/or upper flexible joint 37 into stagnant annular zone 41 located radially beyond cylindrical gas barrier 18 and within the inside surface of gas generator 1 near its lower end and the inside surface of vessel 8 near its upper end. Space 42 between the upper end of gas barrier 18 and the bottom surface of retracted bottom head 40, and space 43 between the outside diameter of annular flange 20 and the inside surface of vertically extending concentric coaxial ring 23 are of sufficient widths to allow differential axial and/or radial growth of the cylindrical gas barrier at the prevailing high temperatures e.g. 1700° F. to 2800° F.

In another embodiment, the means for supporting metal gas barrier 18 consists of extending and attaching, for example, by welding, the upper ends of hanger rods 28 to the bottom of internal lower head 2 of gas generator 1. Gusset plates 26 are thereby eliminated. The other features of this second embodiment of the support means are substantially the same as those in the previously described support means. However, the previously described gusset-type support means is preferable since it reduces the total load on the lower internal head 40 of the gas generator.

It is advantageous to support gas barrier 18 from the gas generator. This allows the entire gas generator refractory (including the throat) to be rebricked and, possibly, partially preheated before the gas generator is mounted on the gas cooler. Therefore, downtime on the unit can be minimized.

While a particular embodiment of the invention has been described above in considerable detail in accordance with the applicable statutes, this is not to be taken as in any way limiting the invention but merely as being descriptive thereof.

We claim:

1. In combination, a first vertical cylindrical shaped elongated high temperature steel pressure vessel provided with a retracted internal lower head containing an exit passage along the central longitudinal axis of said vessel and an upper head containing a coaxial inlet passage for the insertion of a downwardly discharging burner, said first vessel being the exterior shell of a refractory lined reaction zone of a partial oxidation gas generator for the production of synthesis gas, reducing gas, or fuel gas;

a second vertical cylindrical shaped elongated high temperature steel pressure vessel being the exterior shell of a gas cooler for cooling the hot raw effluent gas steam from said reaction zone;

connecting means for joining the lower end of said first vessel to the upper end of said second vessel to provide vertical coaxial alignment along the central longitudinal axis of each vessel; a vertical cylindrical annular shaped elongated refractory throat coaxial with said first and second vessels and extending therebetween for the free passage of said hot raw effluent gas stream from said reaction zone to said gas cooler; a concentric coaxial vertical steel cylindrical gas barrier surrounding along its length the outside diameter of said refractory throat, said gas barrier including a horizontal annular shaped bottom flange comprising inward and outward portions, wherein said inward portion serves as a shelf for supporting said refractory throat;

means for connecting said cylindrical gas barrier to said first vessel; and top and bottom flexible joint sealing means located between the cylindrical gas barrier and a stagnant annular zone radially disposed from said cylindrical gas barrier; wherein substantially no raw effluent gas stream passing through said refractory throat escapes into said stagnant annular zone.

2. The combination of claim 1 provided with a flexible joint for sealing said gas barrier at both the top and bottom.

3. The combination of claim 2 provided with spacing for differential axial and/or radial growth at the bottom and top of said gas barrier.

4. The combination of claim 1 wherein said gas barrier is vertically supported by support means having an upper end which is fastened to said first vessel and a lower end which is free to move by thermal expansion.

5. The combination of claim 4 wherein said support means comprises a plurality of gusset plates that are welded to the inside surface of vessel 1; a vertically extending concentric coaxial ring positioned vertically below said gusset plates and attached to the outward portion of said horizontal flange; and a vertical hanger rod removably connected between each gusset plate and said vertical ring.

6. The combination of claim 4 wherein said support means comprises a vertically extending concentric coaxial ring attached to the outward portion of said horizontal flange; a plurality of vertical hanger rods with each bottom end removably connected to said vertical ring and each upper end secured to the retracted internal lower head of said first vessel.

7. The combination of claim 1 wherein said lower flexible joint gas sealing means comprises a first vertically extending concentric coaxial ring attached to the outward portion of said horizontal flange; an annular shaped horizontal water wall comprising a plurality of water pipes welded together with a gas-tight seal; a vertically extending second concentric coaxial ring spaced radially beyond said first ring and attached to said annular shaped water-wall; and a flexible u-shaped concentric coaxial annular sheet metal ring with opposite edges attached to the outside surface of said first ring and to the inside surface of said second ring.

8. The combination of claim 1 wherein said lower flexible joint gas sealing means comprises a first vertically extending concentric coaxial ring attached to the outward portion of said horizontal flange; an annular shaped plate with the outside diameter being secured to the inside wall of said gas cooler; a vertically extending second concentric coaxial ring spaced radially beyond said first ring and attached to said annular shaped plate; and a flexible u-shaped concentric coaxial annular sheet metal ring with opposite edges attached to the outside surface of said first ring and to the inside surface of said second ring.

9. The combination of claim wherein said upper flexible joint gas sealing means comprises a vertically depending concentric coaxial first ring radially disposed a little beyond said vertical cylindrical gas barrier and welded to the outside surface of said retracted bottom head; and a flexible u-shaped concentric coaxial annular sheet metal ring with apposite edges attached to the outside surface of said vertical cylindrical gas barrier near its top and to the inside surface of said first ring.

* * * * *